US009480873B2

(12) United States Patent
Chuang

(10) Patent No.: US 9,480,873 B2
(45) Date of Patent: Nov. 1, 2016

(54) ADJUSTING STRUCTURE OF ELLIPTICAL TRAINER

(71) Applicant: HIGH SPOT HEALTH TECHNOLOGY CO., LTD., Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 231 days.

(21) Appl. No.: 14/552,569

(22) Filed: Nov. 25, 2014

(65) Prior Publication Data

US 2016/0144222 A1 May 26, 2016

(51) Int. Cl.

| | |
|---|---|
| ***A63B 22/06*** | (2006.01) |
| ***A63B 22/00*** | (2006.01) |
| ***A63B 23/04*** | (2006.01) |

(52) U.S. Cl.

CPC ..... *A63B 22/0015* (2013.01); *A63B 22/0664* (2013.01); *A63B 23/04* (2013.01); *A63B 2022/067* (2013.01)

(58) Field of Classification Search

CPC ..... A63B 22/0664; A63B 22/0605; A63B 22/06; A63B 2022/067; A63B 2022/0676; A63B 2022/0682; A63B 2022/0688; A63B 2022/0611; A63B 2022/0635; A63B 2022/0694; A63B 23/04

See application file for complete search history.

(56) References Cited

U.S. PATENT DOCUMENTS

| | | | | |
|---|---|---|---|---|
| 1,114,458 | A * | 10/1914 | Friedli | A63B 22/0605 297/217.1 |
| 5,529,555 | A * | 6/1996 | Rodgers, Jr. | A63B 22/001 482/51 |
| 8,668,629 | B2 * | 3/2014 | Tamari | A63B 22/0015 482/51 |

* cited by examiner

*Primary Examiner* — Loan H Thanh
*Assistant Examiner* — Rae Fischer
(74) *Attorney, Agent, or Firm* — Alan D. Kamrath; Kamrath IP Lawfirm, P.A.

(57) ABSTRACT

An adjusting structure of an elliptical trainer contains: a base including an upright column, two rotatable posts rotatably connected with the upright column, two driving rods rotatably coupled with the two rotatable posts, a rotating device mounted on the base, and two shafts fixed on two side surfaces of the rotating device. Each shaft is in connection with an adjuster which has a fixing disc, an adjustment disc, and a positioning element. The fixing disc has a plurality of first orifices and a plurality of limiting stems. The adjustment disc has two opposite arcuate slots, a first hole, and a hollow tube. The positioning element is inserted into one of the plurality of first orifices via the hollow tube and the first hole, a hollow fitting sleeve is fitted with the hollow tube, and the hollow fitting sleeve is fitted with each driving rod.

9 Claims, 14 Drawing Sheets

ADJUSTING STRUCTURE OF ELLIPTICAL TRAINER

FIELD OF THE INVENTION

The present invention relates to an adjusting structure of an elliptical trainer which adjusts a desired moving track easily and prolongs a service life.

BACKGROUND OF THE INVENTION

Referring to FIGS. 1 and 2, a conventional adjusting structure of an elliptical trainer contains a base 1, and the base 1 includes a rotating device 2 disposed on a rear end thereof, two connecting pieces 3 mounted on two angular positions of two side surfaces thereof, wherein each connecting piece 3 has a plurality of orifices 31 defined thereon and an adjuster 4 fixed on one end thereof, and a pull pin 5 is secured on one end of the adjuster 4 and is in connection with each of two driving rods, such that the adjuster 4 is rotated, and the pull pin 5 is inserted into one of the plurality of orifices 31, thus adjusting a desired moving track of the elliptical trainer.

However, the conventional adjusting structure still has the following defects:

(1). A connecting length of each connecting piece 3, the adjuster 4, and the pull pin 5 is too long to operate smoothly, thus damaging each connecting piece 3, the adjuster 4, and the pull pin 5 easily.

(2). Each connecting piece 3 and the adjuster 4 are not shielded, so dusts will fall into a gap 6 between each connecting piece 3 and the adjuster 4.

The present invention has arisen to mitigate and/or obviate the afore-described disadvantages.

SUMMARY OF THE INVENTION

The primary object of the present invention is to provide an adjusting structure of an elliptical trainer which adjusts a desired moving track easily and prolongs a service life.

To obtain above object, an adjusting structure of an elliptical trainer provided by the present invention contains: a base including an upright column disposed a front end thereof, two rotatable posts rotatably connected with two sides of an upper end of the upright column, two driving rods rotatably coupled with two lower ends of the two rotatable posts, a rotating device mounted on a rear end of the base, and two shafts fixed on a first eccentric position and a second eccentric position of two side surfaces of the rotating device.

Each shaft is in connection with an adjuster, and the adjuster has a fixing disc, an adjustment disc with a first side surface coupled with the fixing disc, and a positioning element. The fixing disc has a plurality of first orifices defined thereon and a plurality of limiting stems connected with each shaft, the adjustment disc has two opposite arcuate slots formed thereon, such that when the adjustment disc rotates relative to the fixing disc, the plurality of limiting stems slide in each arcuate slot of the adjustment disc, the adjustment disc also has a first hole defined on an eccentric position thereof, a hollow tube extending outwardly from one side of the first hole, the positioning element is inserted into one of the plurality of first orifices via the hollow tube and the first hole, a hollow fitting sleeve is fitted with the hollow tube, and the hollow fitting sleeve is fitted with a rear end of each driving rod.

DETAILED DESCRIPTION OF THE PREFERRED EMBODIMENTS

Figure 1:
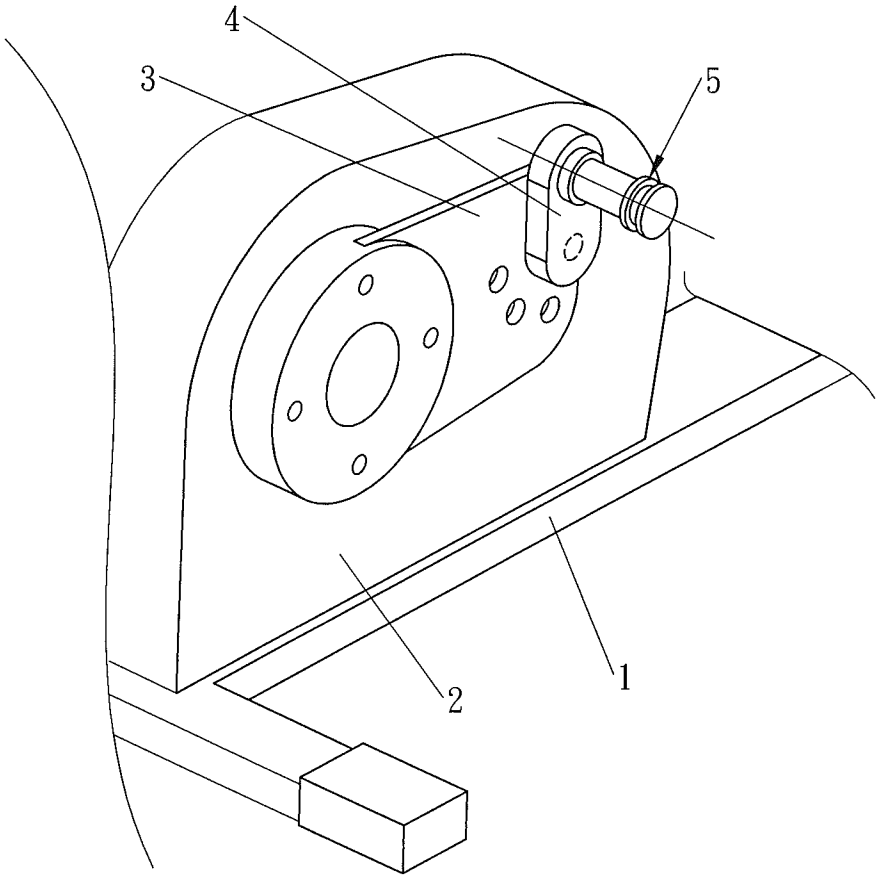
FIG. 1 PRIOR ART
FIG. 1 is a perspective view of a conventional adjusting structure of an elliptical trainer.
Figure 2:
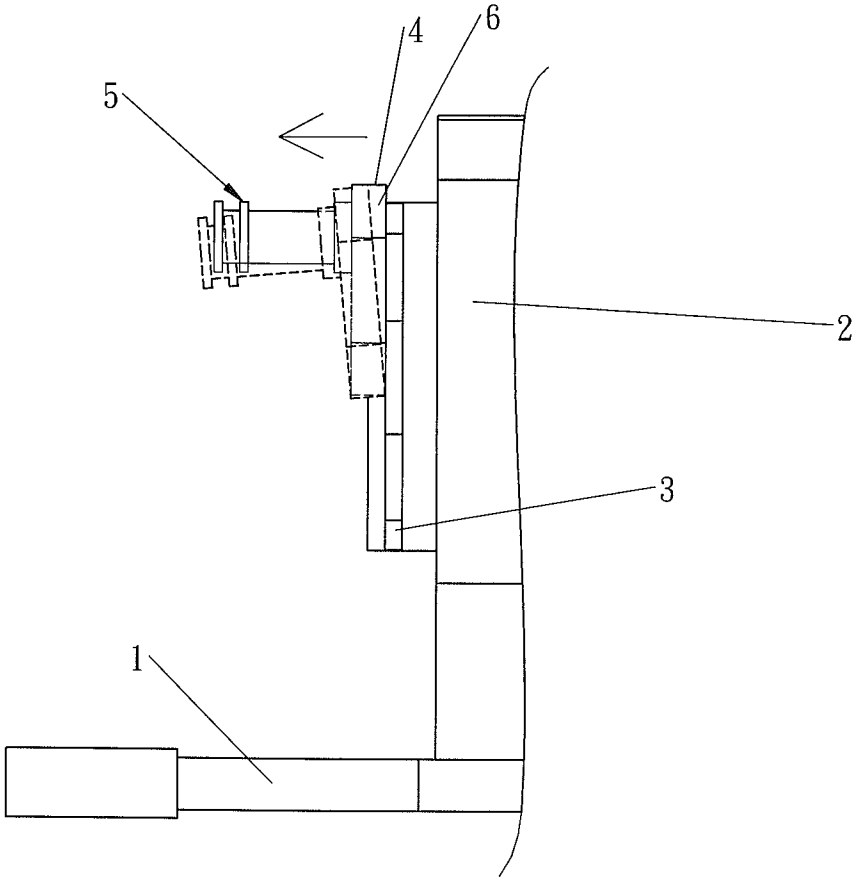
FIG. 2 PRIOR ART
FIG. 2 is a side plan view of the conventional adjusting structure of the elliptical trainer.
Figure 3:
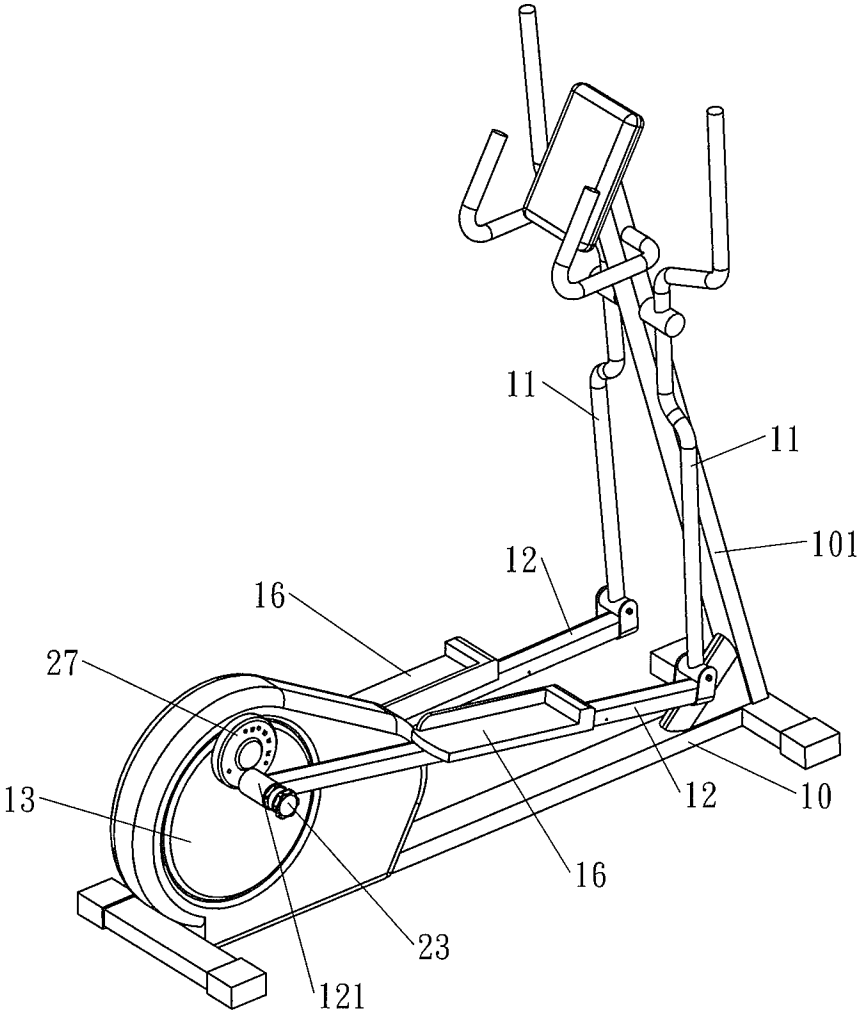
FIG. 3 is a perspective view showing the assembly of an adjusting structure of an elliptical trainer according to a first embodiment of the present invention.
Figure 4:
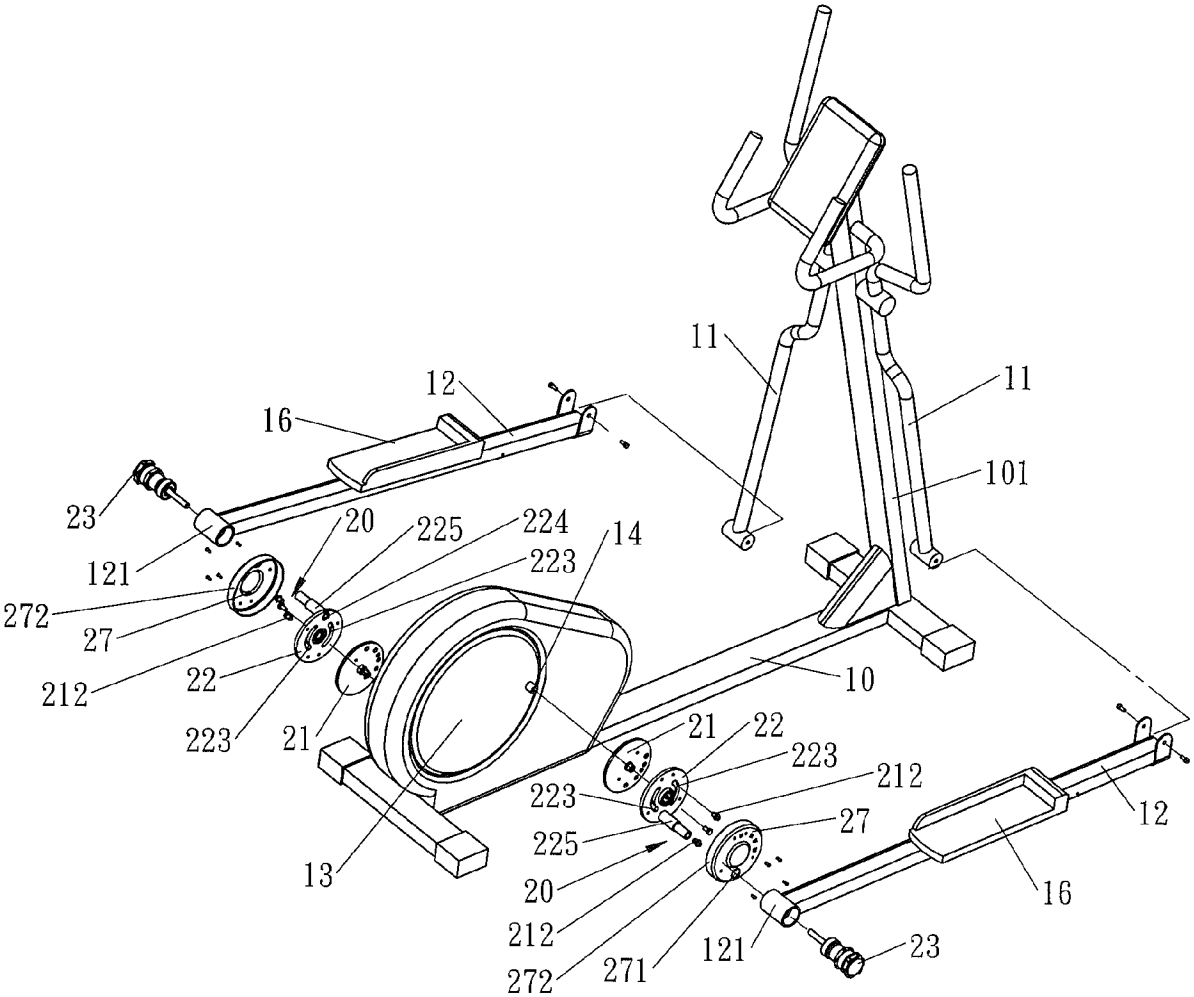
FIG. 4 is a perspective view showing the exploded components of the adjusting structure of the elliptical trainer according to the first embodiment of the present invention.
Figure 5:
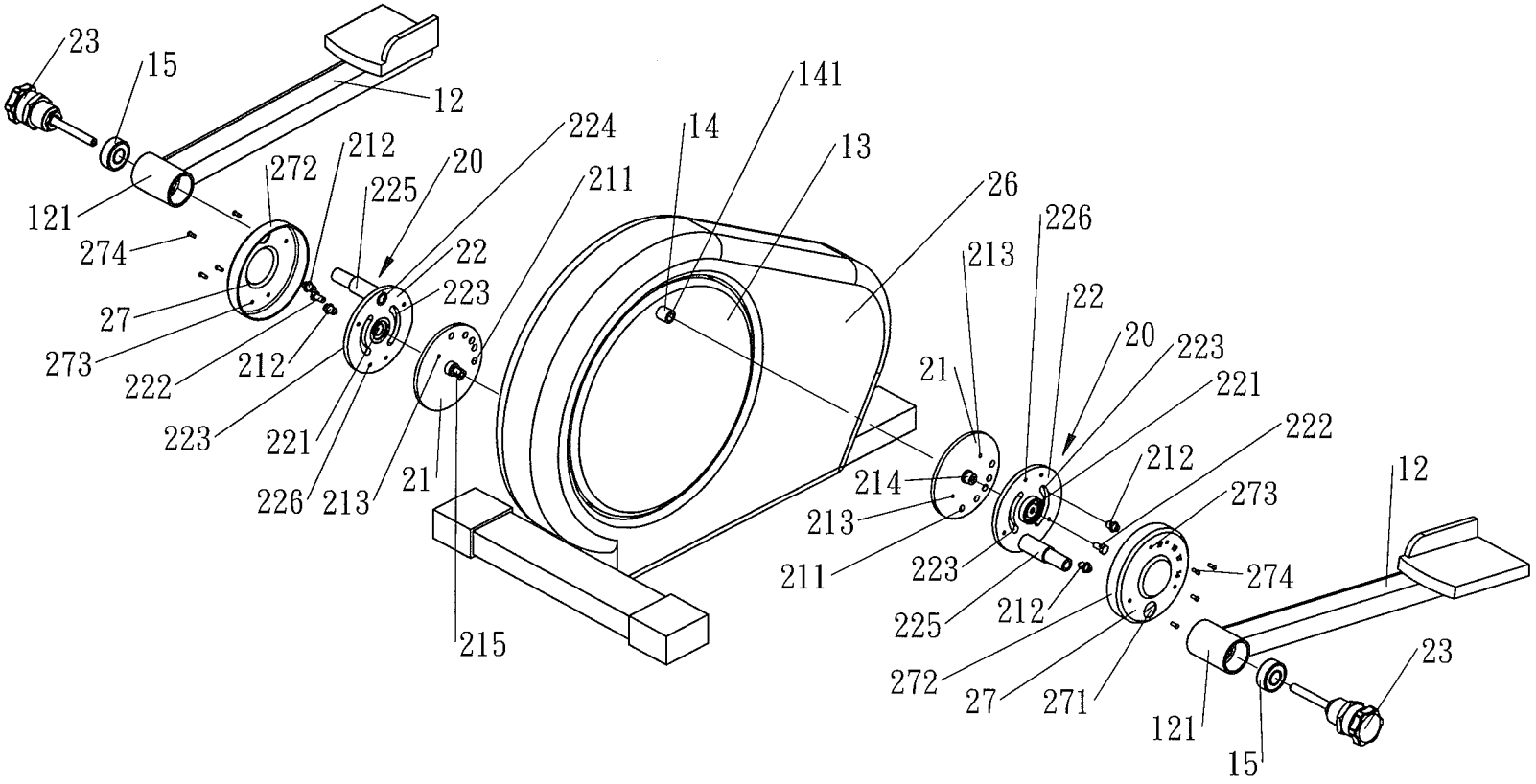
FIG. 5 is a perspective view showing the exploded components of a part of the adjusting structure of the elliptical trainer according to the first embodiment of the present invention.
Figure 6:
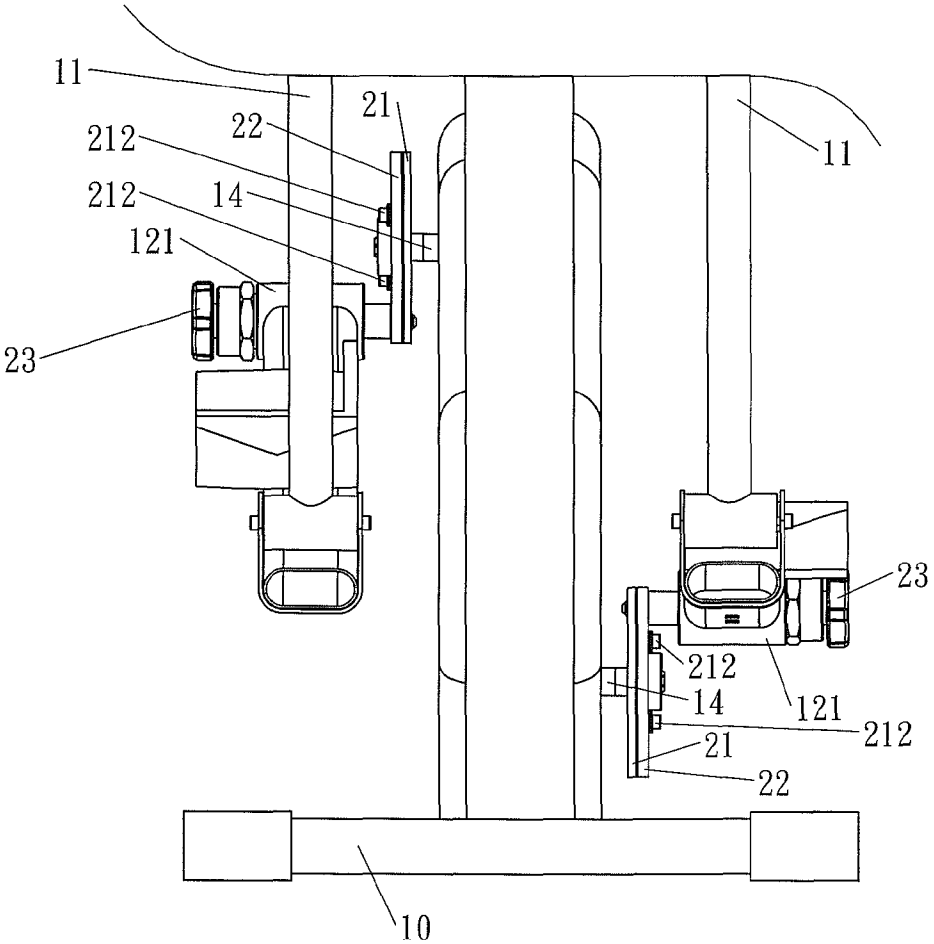
FIG. 6 is a side plan view showing the assembly of a part of the adjusting structure of the elliptical trainer according to the first embodiment of the present invention.
Figure 7:
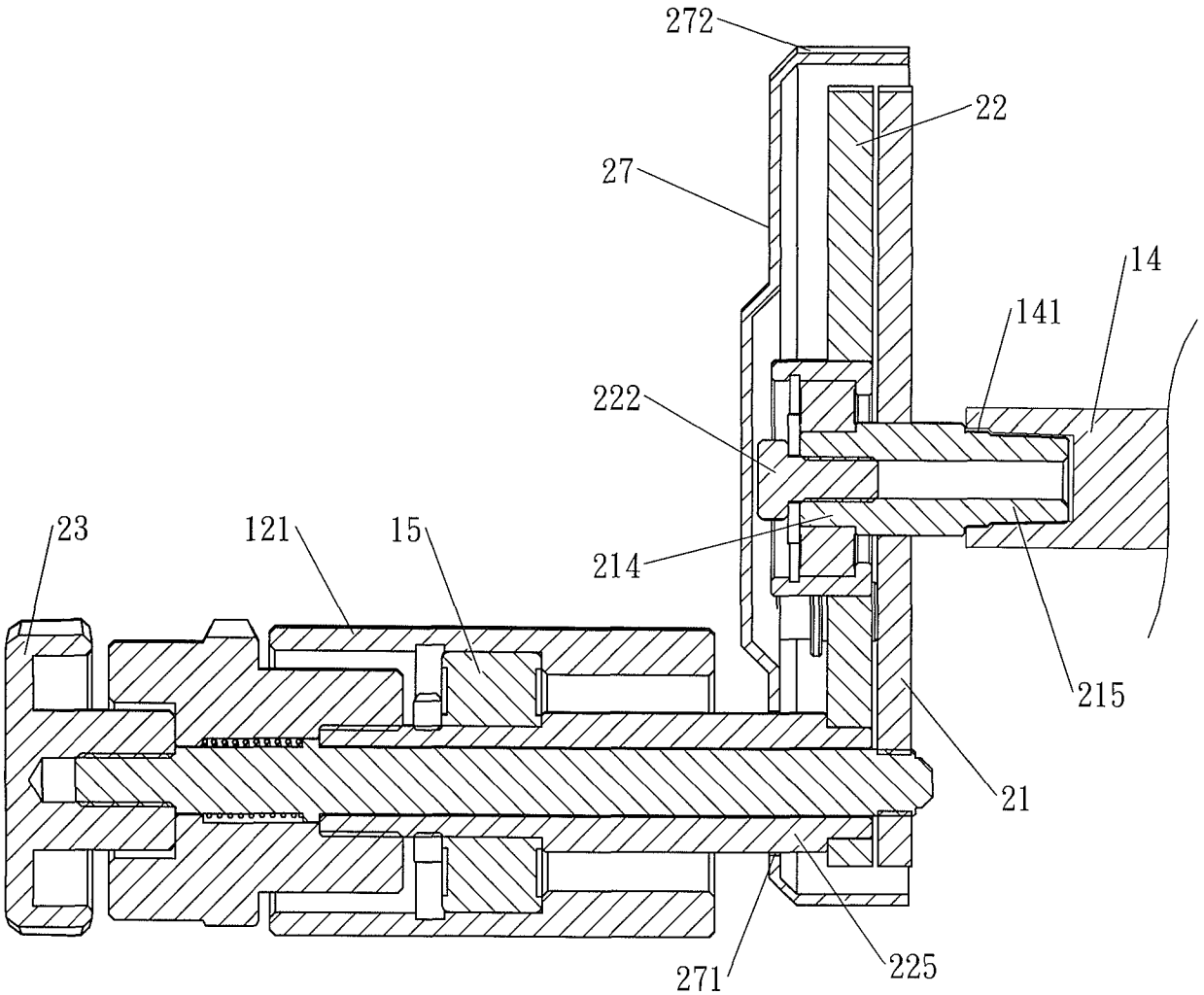
FIG. 7 is a cross sectional view showing the assembly of a part of the adjusting structure of the elliptical trainer according to the first embodiment of the present invention.
Figure 8:
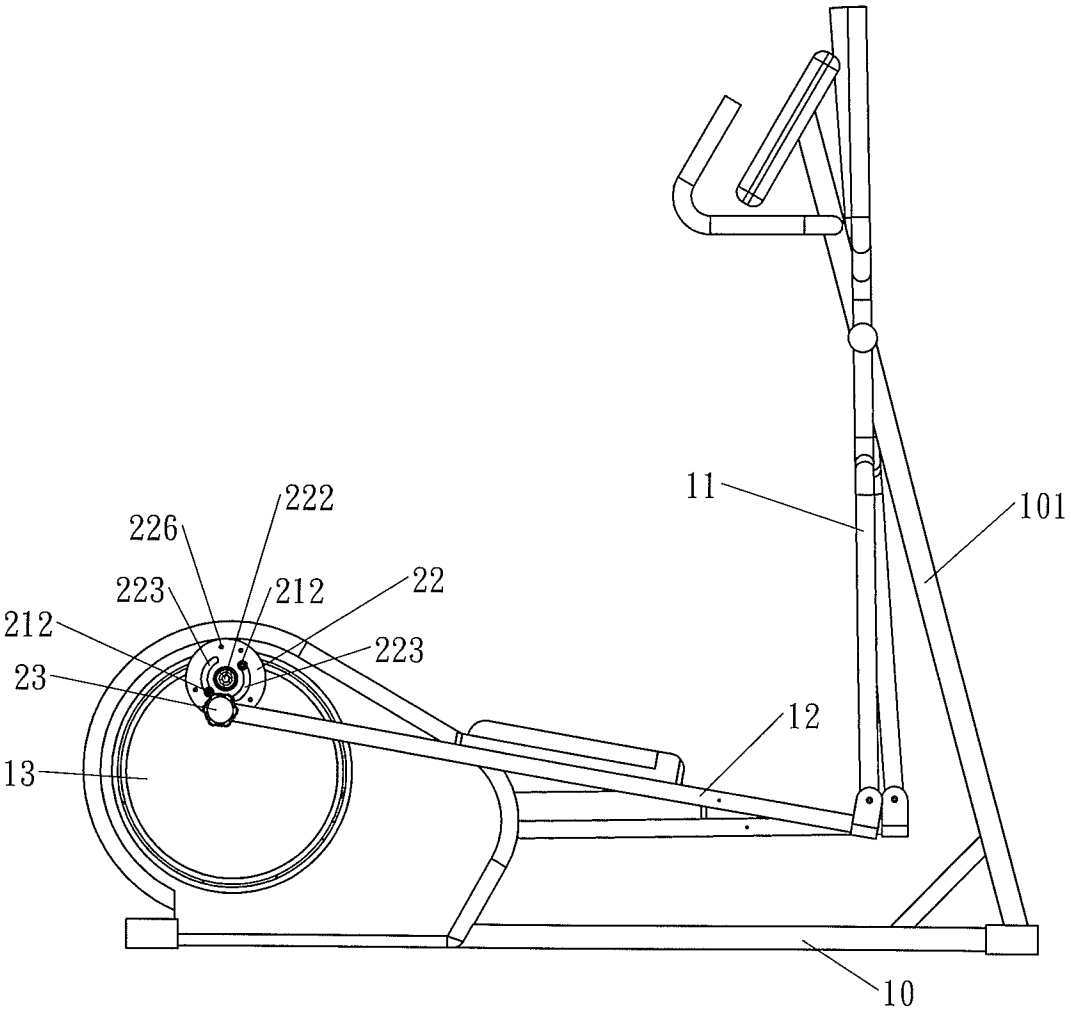
FIG. 8 is a side plan view showing the assembly of the adjusting structure of the elliptical trainer according to the first embodiment of the present invention.
Figure 9:
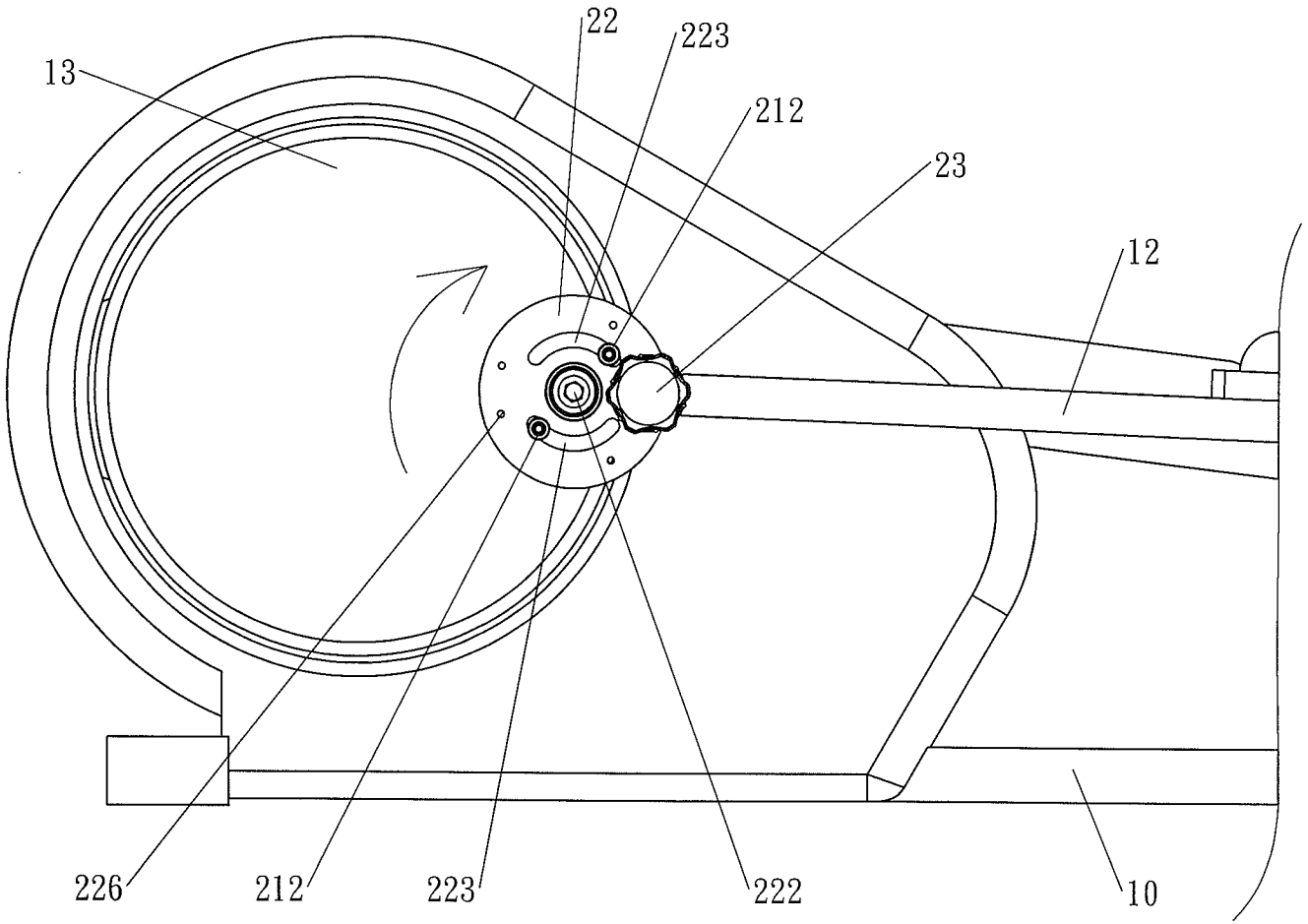
FIG. 9 is a side plan view showing the operation of a part of the adjusting structure of the elliptical trainer according to the first embodiment of the present invention.
Figure 10:
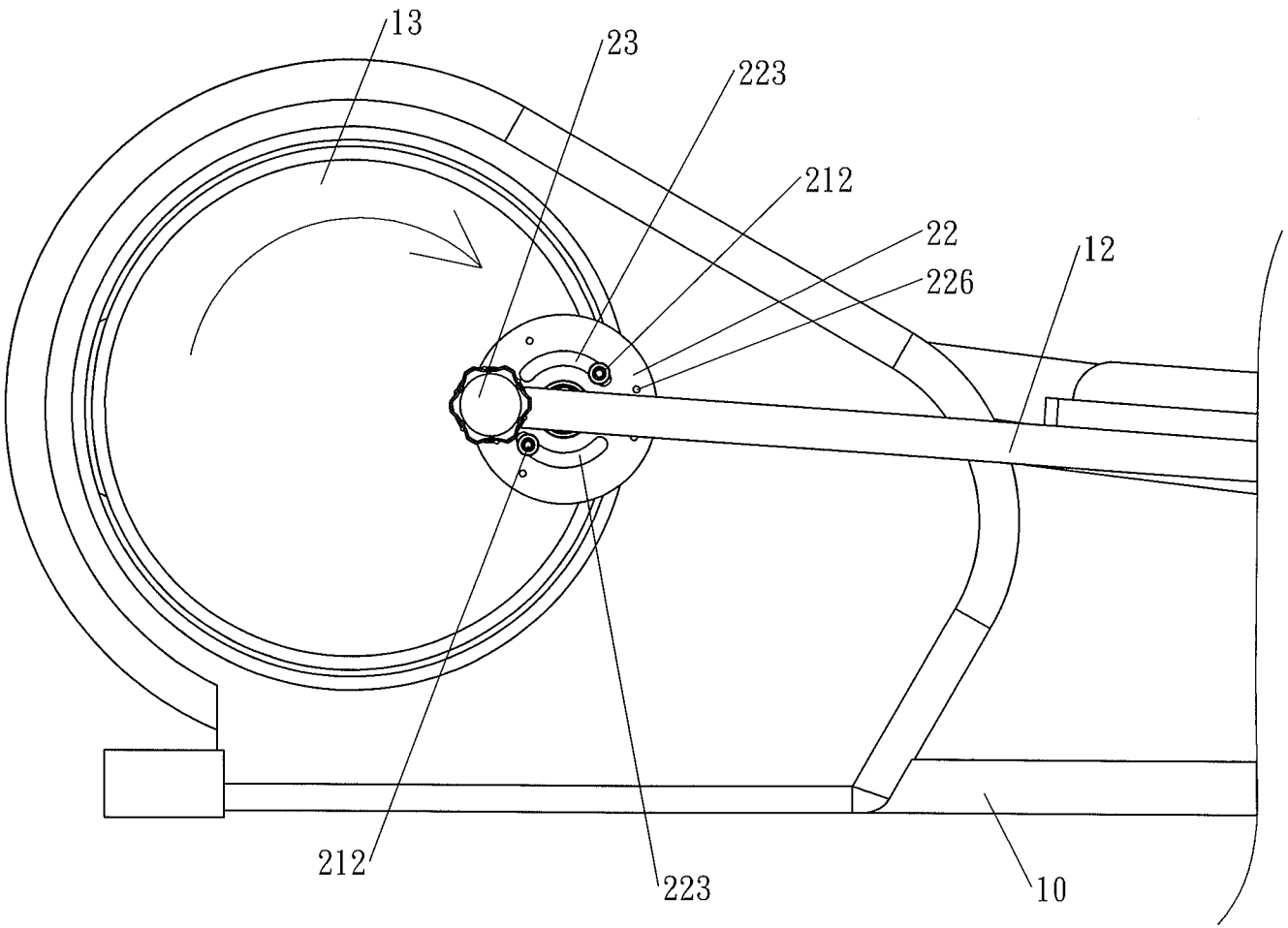
FIG. 10 is another side plan view showing the operation of a part of the adjusting structure of the elliptical trainer according to the first embodiment of the present invention.
Figure 11:
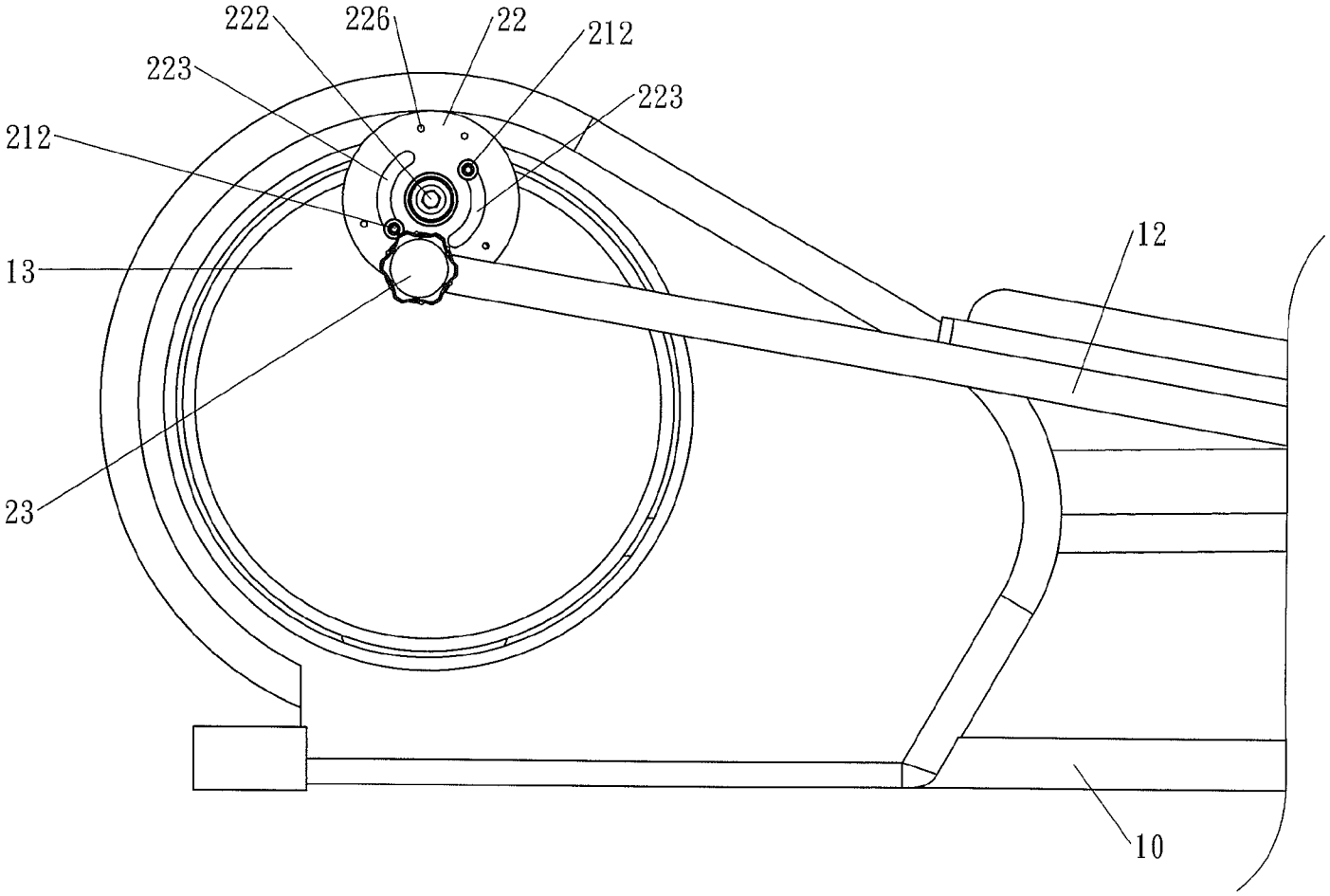
FIG. 11 is also another side plan view showing the operation of a part of the adjusting structure of the elliptical trainer according to the first embodiment of the present invention.
Figure 12:
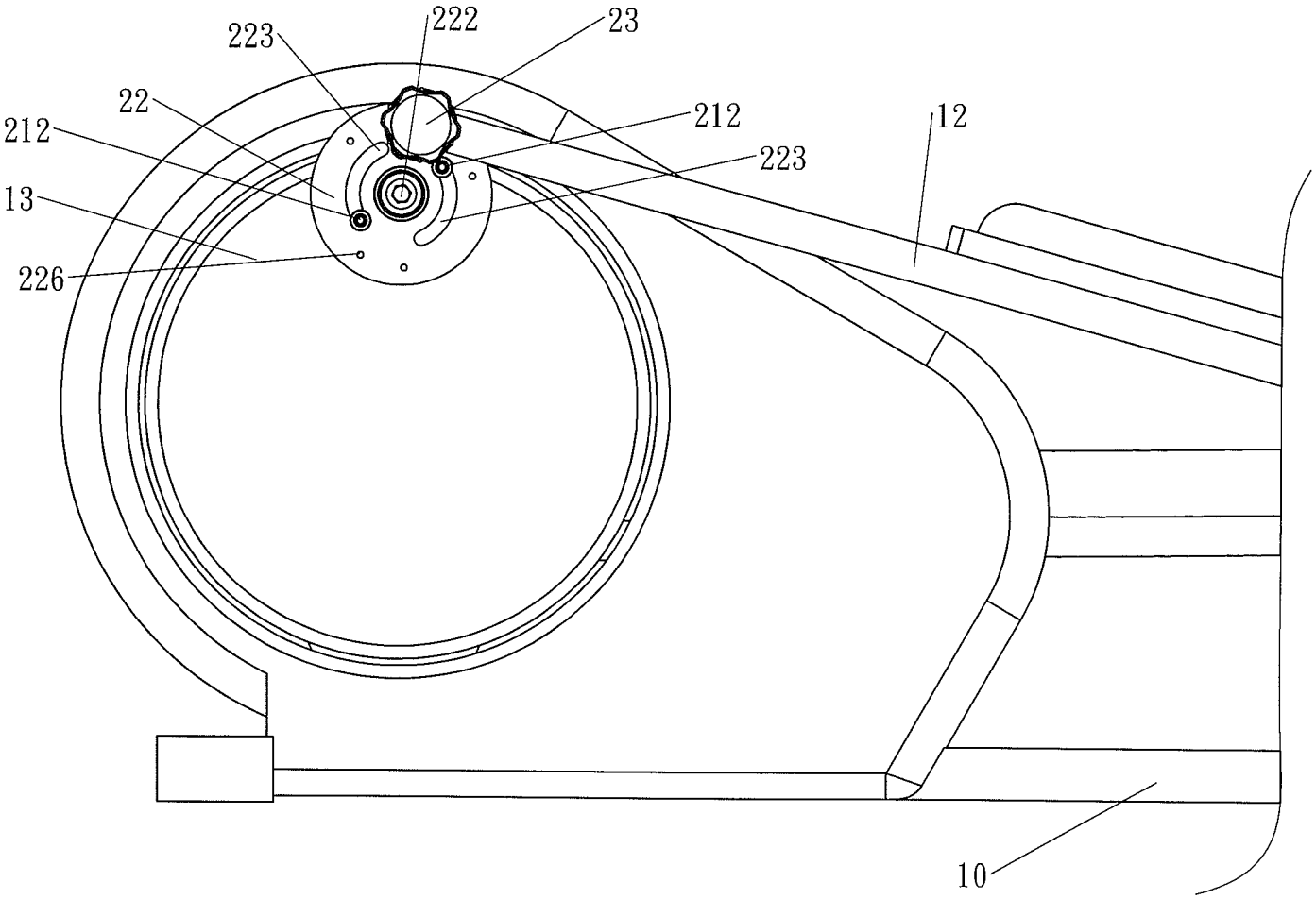
FIG. 12 is still another side plan view showing the operation of a part of the adjusting structure of the elliptical trainer according to the first embodiment of the present invention.

With reference to FIGS. 3 to 7, an adjusting structure of an elliptical trainer is employed to drive a rear flywheel of the elliptical trainer in according to a first embodiment of the present invention and comprises: a base 10 including an upright column 101 disposed a front end thereof, two rotatable posts 11 rotatably connected with two sides of an upper end of the upright column 101, two driving rods 12 rotatably coupled with two lower ends of the two rotatable posts 11, wherein each driving rod 12 has a pedal 16 mounted thereon. The adjusting structure further comprises a rotating device 13 mounted on a rear end of the base 10, two shafts 14 fixed on a first eccentric position and a second eccentric position of two side surfaces of the rotating device 13, wherein each shaft 14 is in connection with an adjuster 20, and the adjuster 20 has a fixing disc 21, an adjustment disc 22 with a first side surface coupled with the fixing disc 21, and a positioning element 23. The fixing disc 21 and the adjustment disc 22 are circular, and a size of the fixing disc 21 is equal to that of the adjustment disc 22. The fixing disc 21 has a plurality of first orifices 211 defined thereon and a plurality of limiting stems 212 connected with each shaft 14. The adjustment disc 22 has two opposite arcuate slots 223 formed thereon, such that when the adjustment disc 22 rotates relative to the fixing disc 21, the plurality of limiting stems 212 slide in each arcuate slot 223 of the adjustment disc 22. The adjustment disc 22 also has a first hole 224 defined on an eccentric position thereof, a hollow tube 225 extending outwardly from one side of the first hole 224. The positioning element 23 is a pull pin for inserting into one of the plurality of first orifices 211 via the hollow tube 225 and the first hole 224, a hollow fitting sleeve 121 is fitted with the hollow tube 225, a bearing 15 is fixed between the hollow fitting sleeve 121 and the hollow tube 225, and the hollow fitting sleeve 121 is fitted with a rear end of each driving rod 12, such that the adjuster 20 is rotated easily and quickly to adjust a moving track, and a rotation of the rotating device 13 relative to the two driving rods 12 is smooth.

Referring further to FIGS. 5 to 12, each shaft 14 has an aperture 141 formed on an end portion thereof, and the fixing disc 21 also has a first peg 215 extending outwardly from a central position of a first side surface thereof, such that the first peg 215 is inserted into the aperture 141 to position the fixing disc 21 on each shaft 14.

The fixing disc 21 further has a plurality of second orifices 213 formed thereon to fit with the plurality of limiting stems 212.

The fixing disc 21 further has a second peg 214 extending outwardly from a central position of a second side surface thereof, and the adjustment disc 22 further has a pore 221 defined on a central position thereof to fit with the second peg 214, such that the adjustment disc 22 is connected with the fixing disc 21. Preferably, the first peg 215 and the second peg 214 are one piece formed and are weld on the fixing disc 21.

The adjustment disc 22 further has a protective cover 27 coupled with a second side surface thereof, and the protective cover 27 has an eccentric opening 271 for inserting the hollow tube 225. The protective cover 27 also has a plurality of through openings 273 and a peripheral rib 272 extending outwardly around a peripheral side of one side surface thereof, wherein the peripheral rib 272 shields the adjustment disc 22 and the fixing disc 21, and the adjustment disc 22 further has a plurality of second holes 226 arranged thereon and corresponding to the plurality of through openings 273 of the protective cover 27, such that a plurality of screws 274 are screwed with the plurality of second holes 226 via the plurality of through openings 273.

Figure 13:
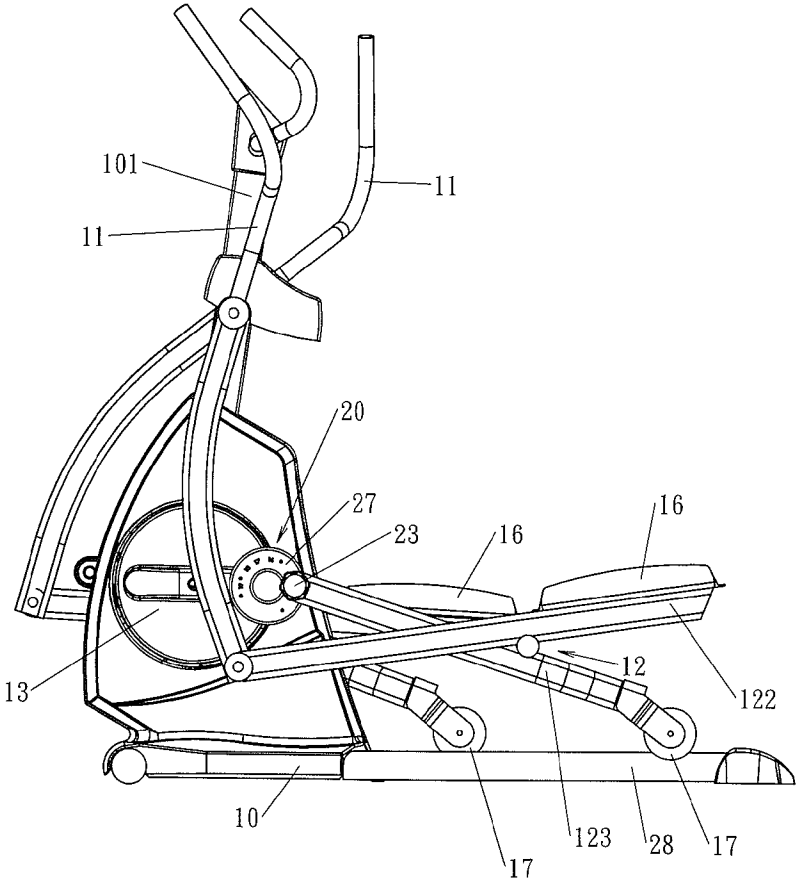
FIG. 13 is a side plan view showing the assembly of an adjusting structure of an elliptical trainer according to a second embodiment of the present invention.
Figure 14:
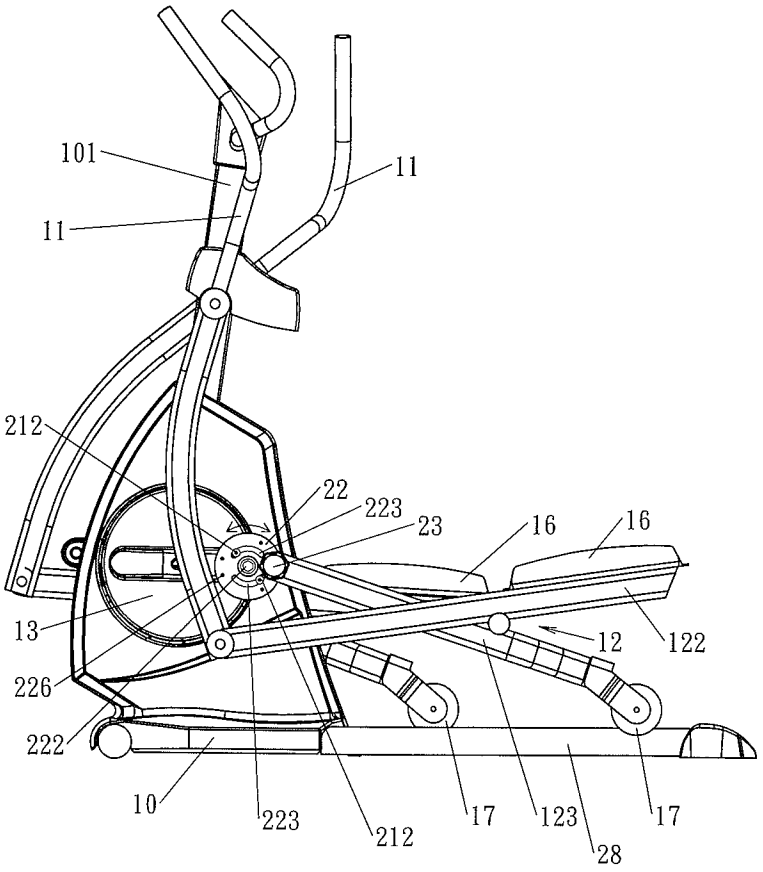
FIG. 14 is another side plan view showing the assembly of the adjusting structure of the elliptical trainer according to the second embodiment of the present invention.

With reference to FIGS. 13 to 14, an adjusting structure of an elliptical trainer is employed to drive a front flywheel of the elliptical trainer in according to a second embodiment of the present invention. A difference of the adjusting structure of the second embodiment from that of the first embodiment comprises: a rotating device 13 mounted on a front end of a base 10; the base 10 including a guiding rail 28 disposed on a rear end thereof, and each of two driving rods 12 having a main extension 122 and an auxiliary extension 123, wherein a middle section of the main extension 122 is connected with a middle section of the auxiliary extension 123, and a front end of the main extension 122 is rotatably coupled with a lower end of each rotatable post 11, the main extension 122 has a pedal 16 disposed on the middle section thereof, and a front end of the auxiliary extension 123 is fitted with the hollow fitting sleeve 121, a rear end of the auxiliary stem 123 is rotatably connected with a roller 17 for rolling forward and backward on the guiding rail 28, such that the adjuster 20 is fixed between each shaft 14 and the hollow fitting sleeve 121. Since a structure and a movement of the adjuster 20 of the second embodiment are identical to those of the first embodiment, its further remarks are omitted.

As shown in FIGS. 3 to 14, in operation, the positioning element 23 is removed from the hollow tube 225, the hollow fitting sleeve 121, and the one of the plurality of first orifices 211; the adjustment disc 22 is rotated (in the meantime, the protective cover 27 rotates with the adjustment disc 22), and the plurality of limiting stems 212 slide in each arcuate slot 223 of the adjustment disc 22, thereafter the positioning element 23 of the adjuster 20 is inserted into another of the plurality of first orifices 211, thus adjusting the moving track.

Accordingly, the adjusting structure of the elliptical trainer has advantages as follows:

(1). The adjustment disc 22 is coupled with the fixing disc 21, and the plurality of limiting stems 212 slide in each arcuate slot 223 of the adjustment disc 22, hence when the elliptical trainer runs in an elliptical movement, and the rotating device 13 rotates, the fixing disc 21 and the adjustment disc 22 are securely coupled together, thus prolonging a service life of the adjuster 20.

(2). The peripheral rib 272 of the protective cover 27 shields the adjustment disc 22 and the fixing disc 21, such that dusts will not fall into a first gap 29 between the rotating device 13 and the fixing disc 21, and the dusts will not enter into a second gap 30 defined between the adjustment disc 22 and the fixing disc 21, thus the rotation of the rotating device 13 relative to the adjuster 20 is smooth. Preferably, the protective cover 27 shields the adjustment disc 22 and the fixing disc 21 to enhance aesthetics appearance.

(3) The hollow tube 225, the hollow fitting sleeve 121, and the positioning element 23 are coaxially connected together, the hollow fitting sleeve 121 is held by user's one hand, and the positioning element 23 (i.e., the pull pin) is pulled by user's the other hand, thereafter the adjustment disc 22 is adjustably rotated, the positioning element 23 (i.e., the pull pin) is inserted into another of the plurality of first orifices 211, thereby adjusting the moving track quickly and easily.

While we have shown and described various embodiments in accordance with the present invention, it is clear to those skilled in the art that further embodiments may be made without departing from the scope of the present invention.

What is claimed is:

1. An adjusting structure of an elliptical trainer comprising: a base including an upright column disposed at a front end of the base, two rotatable posts rotatably connected with two sides of an upper end of the upright column, two driving rods rotatably coupled with two lower ends of the two rotatable posts, a rotating device mounted on a rear end of the base, and two shafts fixed on a first eccentric position and a second eccentric position of two side surfaces of the rotating device; wherein each shaft is in connection with an adjuster, and the adjuster has a fixing disc, an adjustment disc with a first side surface coupled with the fixing disc, and a positioning element; the fixing disc has a plurality of first orifices defined thereon and a plurality of limiting stems connected with each shaft, the adjustment disc has two opposite arcuate slots formed thereon, such that when the adjustment disc rotates relative to the fixing disc, the plurality of limiting stems slide in each arcuate slot of the adjustment disc, the adjustment disc also has a first hole defined on an eccentric position thereof, a hollow tube extending outwardly from one side of the first hole, the positioning element is inserted into one of the plurality of first orifices via the hollow tube and the first hole, a hollow fitting sleeve is fitted with the hollow tube, and the hollow fitting sleeve is fitted with a rear end of each driving rod.

2. The adjusting structure of the elliptical trainer as claimed in claim 1, wherein the fixing disc and the adjustment disc are circular, and a size of the fixing disc is equal to that of the adjustment disc.

3. The adjusting structure of the elliptical trainer as claimed in claim 1, wherein each shaft has an aperture formed on an end portion thereof, and the fixing disc also has a first peg extending outwardly from a central position of a first side surface thereof, such that the first peg is inserted into the aperture to position the fixing disc on each shaft.

4. The adjusting structure of the elliptical trainer as claimed in claim 1, wherein the fixing disc further has a plurality of second orifices formed thereon to fit with the plurality of limiting stems.

5. The adjusting structure of the elliptical trainer as claimed in claim 1, wherein the fixing disc further has a second peg extending outwardly from a central position of a second side surface thereof, and the adjustment disc further has a pore defined on a central position thereof to fit with the second peg, such that the adjustment disc is connected with the fixing disc.

6. The adjusting structure of the elliptical trainer as claimed in claim 1, wherein the adjustment disc further has a protective cover coupled with a second side surface thereof, and the protective cover has an eccentric opening for inserting the hollow tube, the protective cover also has a peripheral rib extending outwardly around a peripheral side of one side surface thereof to shield the adjustment disc and the fixing disc.

7. The adjusting structure of the elliptical trainer as claimed in claim 1, wherein the positioning element is a pull pin.

8. The adjusting structure of the elliptical trainer as claimed in claim 1, wherein when the hollow fitting sleeve is fitted with the hollow tube, a bearing is fixed between the hollow fitting sleeve and the hollow tube.

9. The adjusting structure of the elliptical trainer as claimed in claim 1, wherein each driving rod has a main extension and an auxiliary extension, a middle section of the main extension is connected with a middle section of the auxiliary extension, and a front end of the main extension is rotatably coupled with a lower end of each rotatable post, the main extension has a pedal disposed on the middle section thereof, and a front end of the auxiliary extension is fitted with the hollow fitting sleeve, a rear end of the auxiliary stem is rotatably connected with a roller.

* * * * *